United States Patent [19]

Joyce et al.

[11] 4,159,676

[45] Jul. 3, 1979

[54] STAMPING MACHINE

[75] Inventors: Darrell L. Joyce; Richard E. Kessler, both of Houston, Tex.

[73] Assignee: Gachman Steel Company, Fort Worth, Tex.

[21] Appl. No.: 847,247

[22] Filed: Oct. 31, 1977

[51] Int. Cl.[2] ..... B44B 5/00

[52] U.S. Cl. ..... 101/3 R; 101/4; 101/316; 173/128

[58] Field of Search ..... 101/3 R, 4, 27, 316, 101/26; 173/114, 128, 132; 72/445, 453.02, 453.18, 465

[56] References Cited

U.S. PATENT DOCUMENTS

| | | | |
|---|---|---|---|
| 2,427,358 | 9/1947 | Kovatch | 101/3 R |
| 2,559,478 | 7/1951 | Stone | 173/128 X |
| 2,934,049 | 4/1960 | Spurlin | 173/128 X |
| 3,008,365 | 11/1961 | McNabb | 101/4 X |
| 3,149,562 | 9/1964 | Wilkins et al. | 101/3 R X |
| 3,332,273 | 7/1967 | Beche | 72/453.18 X |
| 3,608,650 | 9/1971 | Matsusaka | 173/114 |
| 3,762,484 | 10/1973 | Speicher | 101/3 R X |
| 3,886,860 | 6/1975 | Hayakawa | 101/316 |

*Primary Examiner*—Edward M. Coven
*Attorney, Agent, or Firm*—Robert A. Felsman

[57] ABSTRACT

A stamping machine for stamping identifying symbols into steel plates. A hammer is reciprocally carried by a guide track. An anvil with a die on its lower end is also reciprocally carried by the guide track for receiving blows from the hammer. The anvil has a platform with a spring compressed between it and a point on the guide track. A linking member with end stops on its upper end extends between the platform and the guide track near the top of the hammer stroke. The plate is mounted above the hammer and carried by the rods. The hammer lifts the plate, and the plate lifts the rods, as the hammer approaches the end of its return stroke, to allow the workpiece to be removed. The spring urges the anvil downward to retain the die against the workpiece prior to the anvil being struck by the hammer.

8 Claims, 4 Drawing Figures

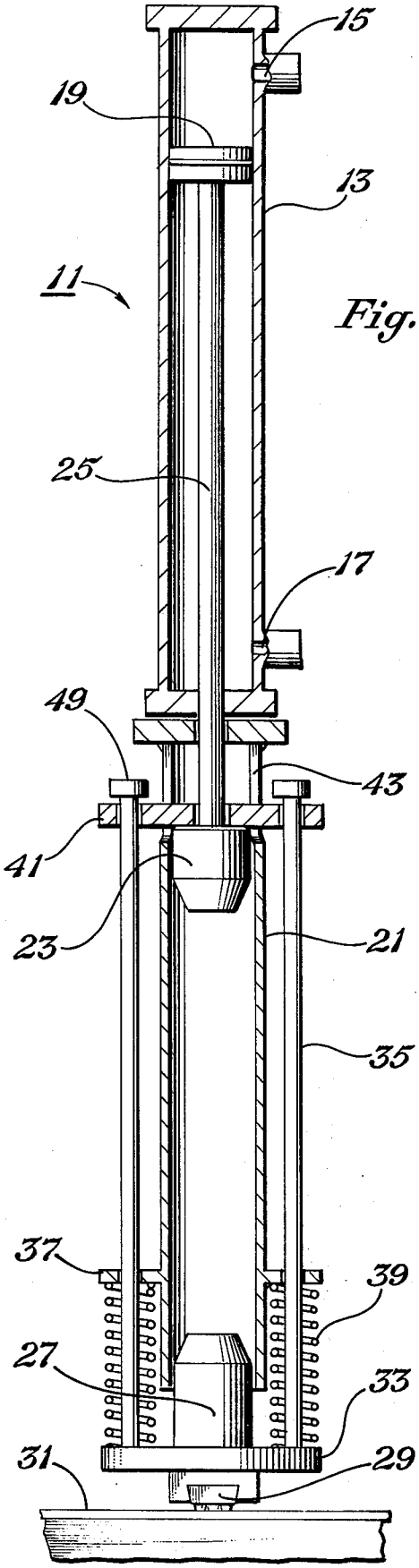
Fig. 3
Fig. 4
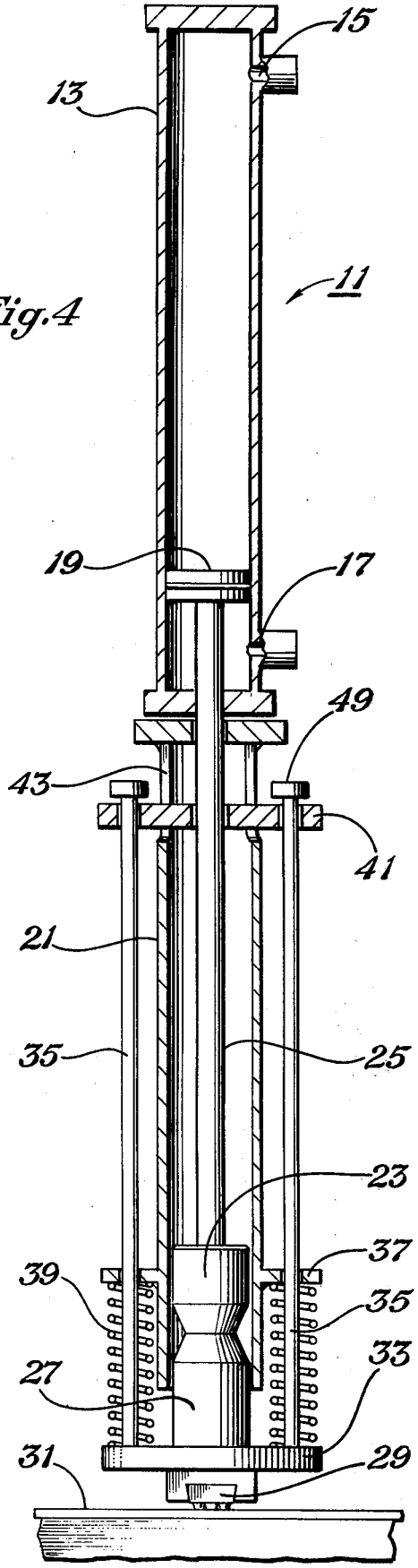

STAMPING MACHINE

BACKGROUND OF THE INVENTION

1. Field of the Invention

This invention relates in general to stamping machines, particularly to a device for stamping identifying symbols on steel plates.

2. Description of the Prior Art

In the process of fabricating individual sheets of steel plate from coils of steel, identifying symbols are required to be stamped on each sheet. The stamping operation is preferably performed while the sheet is at room temperature, consequently, a substantial amount of force is required. In addition, it is desirable for the die to be in contact with the plate prior to being struck by the hammer to avoid a double blow.

Stamping devices that place the die in contact with the workpiece prior to the blow are shown in U.S. Pat. Nos. 2,427,358 and 3,608,650. The device of the first patent is unnecessarily complex, and the device of the latter patent requires two air valves and control circuitry. One air valve and system is for restraining the die, and the other air valve and system is for operating the hammer. It is desirable to avoid the dual air control system.

SUMMARY OF THE INVENTION

The stamping device of this invention uses an air driven hammer and a spring loaded retention system. The hammer is mounted to a guide track and reciprocated by pneumatic means. The anvil is located at the bottom of the guide track and is independently moveable with respect to it. A spring is compressed between the anvil and a point above it on the guide track to urge the anvil downward. A linking member, mounted on a platform connected to the anvil, extends upward for a distance equal to the stroke length. A plate is mounted on the guide track above the piston and has sides that engage the linking member at its top. The hammer pushes the plate and the linking member upward as it nears the top of its return stroke to lift the die. On the forward stroke, the spring urges the anvil down prior to being struck by the hammer.

BRIEF DESCRIPTION OF THE DRAWINGS

FIG. 3 is a vertical cross-sectional view of the stamping device of FIG. 1, with the hammer in an intermediate position.

FIG. 4 is a vertical cross-sectional view of the stamping device of FIG. 1, with the hammer in its lowest position.

DESCRIPTION OF THE PREFERRED EMBODIMENT

Figure 1:
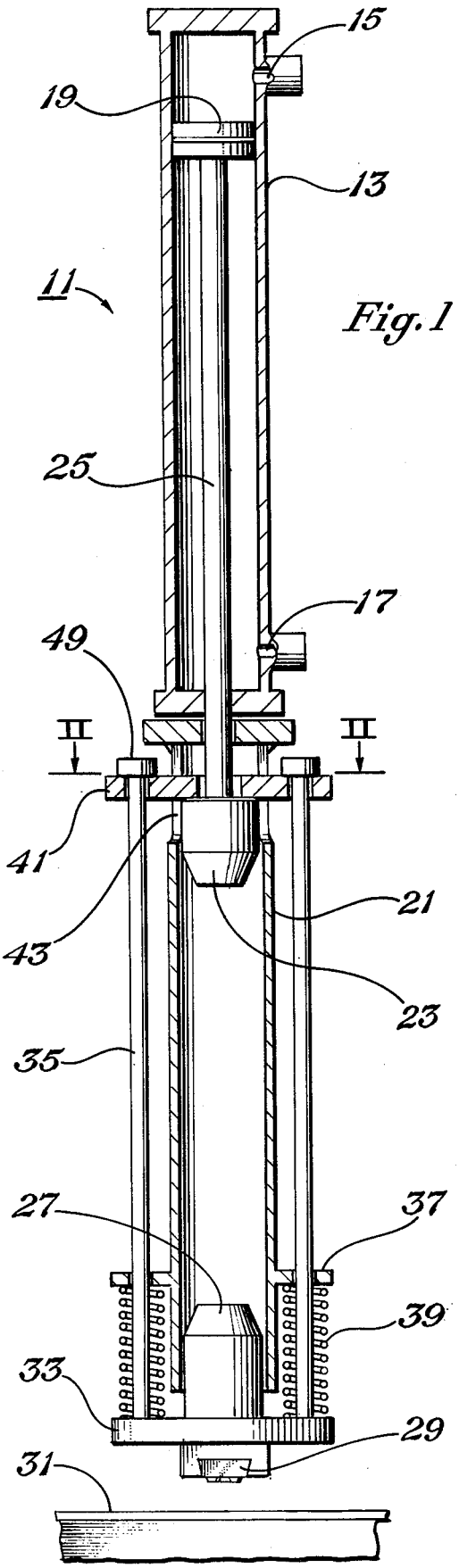
FIG. 1 is a vertical cross-sectional view of a stamping device constructed in accordance with this invention, with the hammer in its top position.

Referring to FIG. 1, the stamping device 11 includes a cylindrical pneumatic chamber 13. Ports 15, 17 are mounted at the top and bottom, respectively, of chamber 13, and lead to an air supply and control circuitry (not shown). A piston 19 is carried reciprocally in chamber 13. Piston 19 is reciprocated by alternate supply of air through ports 15 and 17.

A guide track 21 in the shape of a cylindrical tube is mounted below chamber 13 with a common longitudinal axis with chamber 13. A hammer 23 is reciprocally carried in guide track 21, and is connected by shaft 25 to piston 19 so as to be moveable therewith. Chamber 13, piston 19, shaft 25, and the associated air supply and control system serve as means for reciprocating the hammer.

An anvil 27 is carried near the bottom of the guide track 21, and is independently moveable with respect to it. Anvil 27 is generally cylindrically shaped, and fits within guide track 21 so that its upper end receives blows from the hammer 23. A stamping die 29 is located on its lower end for striking the workpiece 31, usually a steel plate. A platform or flange 33 extends laterally outward on the opposite sides from anvil 27, past the walls of guide track 21.

A linking member comprising two cylindrical rods 35, extends upwardly from platform 33 substantially the length of the hammer 23 stroke. Each rod 35 is rigidly connected to opposite sides of the platform 33. A pair of flanges 37 are welded on opposite sides of the walls of the guide track 21 at a selected point above the bottom of the guide track. Rods 35 are inserted through apertures in flanges 37. Coil springs 39 encircle each rod 35 between the flanges 37 and platform 33. The length of each spring 39 is selected so as to place the spring under compression even when die 29 is in contact with workpiece 21, as shown in FIGS. 3 and 4.

Figure 2:
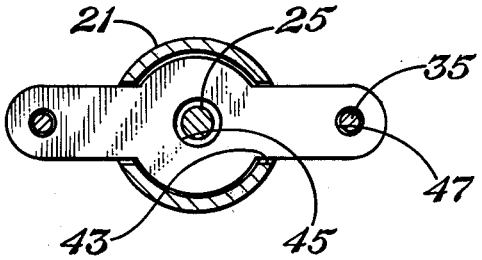
FIG. 2 is a cross-sectional view of the stamping device of FIG. 1 taken along the lines from II—II.

Referring also to FIG. 2, a plate 41 is located near the upper ends of rods 35. Plate 41 is substantially the width of platform 33, having sides that protrude through slots 43 in the walls of guide track 21. Plate 41 is located above hammer 23, with a center aperture 45 through which shaft 25 loosely passes. Plate 41 also has side apertures 47 through which the rods 35 loosely pass. Each rod 35 has a threaded nut 49 on its top that serves as an endstop. Apertures 47 are smaller than nuts 49, thus allowing plate 41 to serve as a lifting means for lifting rods 35 and the die 29 when the hammer 23 is in contact with plate 41 near the top of its stroke. Slots 43 are of length greater than or equal to the distance desired for the die 29 to move between its lower and upper positions.

In operation, the workpiece is inserted below die 29 when the hammer 23 is in its top or returned position. Air pressure is exerted through port 17, maintaining piston 19 in its top position. Hammer 23 bears against plate 41, which in turn bears against nuts 49 holding the die 29 in its upper position and compressing springs 39.

At the beginning of the power stroke, air pressure is removed from port 17 and placed on port 15, driving piston 19 downward. Hammer 23 begins moving downward, being assisted by coil springs 39. Plate 41 moves downward along with hammer 23 until the die 29 contacts workpiece 31, as shown in FIG. 2. The urging of springs 39 restrains the die 29 against the workpiece 31 while hammer 23 continues its downward movement, striking anvil 27 as shown in FIG. 3.

The control circuitry then applies air pressure to port 17, and exhausts through port 15, raising piston 19 and hammer 23. Once the hammer has risen far enough to contact plate 41, anvil 27 will then be pulled up to the selected distance by rods 35, as shown in FIG. 1.

It should be apparent that an invention having significant improvements has been provided. The device is simple in structure and operation. The coil springs provide sufficient force to restrain the die prior to the anvil being struck by the hammer. The linkage members, platform, and plate, automatically raise the die for the insertion of the next piece after each stamping operation.

While the invention has been shown in only one of its forms, it should be apparent that it is not so limited, but is susceptible to various changes and modifications without departing from the spirit thereof.

We claim:

1. A stamping machine, comprising:
a guide track;
a hammer reciprocally carried by the guide track;
reciprocating means for reciprocating the hammer in a down stroke and an upward return stroke;
an anvil reciprocally carried by the guide track for receiving blows from the hammer, the anvil having a die on its lower end for stamping a workpiece, and having a platform extending outwardly from the anvil;
spring means compressed between the platform and a point on the guide track above the platform, for urging the anvil and die downward into contact with the workpiece;
a linking member, connected to the platform and extending upward substantially the length of the hammer stroke; and
lifting means, cooperating with the hammer, for engaging and lifting the linking member on the return stroke thereby lifting the die a selected distance from the workpiece and compressing the spring.

2. The apparatus according to claim 1 wherein the linking member comprises two rods connected to the platform on opposite sides of the guide track with end stops on the upper ends.

3. The stamping device according to claim 2 wherein the lifting means comprises:
a plate mounted reciprocally above the hammer so as to be contacted by the hammer a selected distance below the top of the return stroke, the plate having apertures through which the rods extend, the apertures being smaller than the end stops so that the plate lifts the rods when pushed upward by the hammer.

4. The stamping device according to claim 3 wherein the guide track is a cylindrical tube with slots in the walls for the sides of the plate to protrude.

5. The stamping device according to claim 4 wherein the spring means comprises two coil springs, each encircling one of the rods.

6. The stamping device according to claim 1 wherein the reciprocating means is pneumatically powered and comprises:
a cylindrical chamber mounted to the top of the guide track;
a piston reciprocally carried in the chamber and connected to the hammer by a shaft; and
a pair of ports in the chamber, one located above the top of the stroke of the piston and the other below the bottom of the stroke of the piston, for receiving and discharging air.

7. A stamping machine, comprising:
a guide track;
a hammer reciprocally carried by the guide track;
a cylindrical chamber mounted above the guide track;
a piston reciprocally carried in the chamber and connected to the hammer by a shaft;
pneumatic means for reciprocating the piston and the hammer in a down stroke and an upward return stroke by air pressure;
an anvil reciprocally carried by the guide track at its bottom for receiving blows from the hammer, the anvil having a die on its lower end for stamping a workpiece, and having a platform extending outwardly from the anvil;
spring means, compressed between the platform and a point on the guide track above the platform, for urging the anvil downward;
a pair of rods connected to the platform, one on each side of the guide track and extending upward substantially the length of the hammer stroke; and
a plate positioned above the hammer with a center aperture through which the shaft loosely passes, the plate having side portions engaged with the rods, the plate being positioned at a distance selected that allows it to be contacted and lifted by the hammer prior to reaching the top of the return stroke so as to lift the rods and the anvil as the hammer nears the top of its return stroke.

8. A stamping machine, comprising:
a tube having an upper end with a pair of slots, one on each side and adjacent to the upper end;
a hammer reciprocally carried in the tube;
a cylindrical chamber mounted above the tube with a common longitudinal axis;
a piston reciprocally carried in the chamber and connected to the hammer by the shaft;
pneumatic means for reciprocating the piston and the hammer in a down stroke and an upward return stroke by air pressure;
an anvil reciprocally carried by the tube at its bottom for receiving blows from the hammer, the anvil having a die on its lower end for stamping a workpiece, and having a platform extending outwardly from the anvil;
a pair of rods each having enlarged end stops on their upper ends, connected to the platform, one on each side of the tube and extending upward substantially the length of the hammer stroke;
a pair of coil springs, one inserted over each rod and compressed between the platform and a point on the tube, to urge the anvil downward; and
a plate carried in the tube reciprocally on the shaft between the piston and the hammer, with side portions that protrude through the slots, each side portion having an aperture for reciprocally receiving one of the rods, the apertures being smaller than the end stop, the plate being positioned so as to be contacted and lifted by the hammer as it nears the top of the return stroke so as to lift the rods and the anvil as the hammer nears the top of the return stroke, the springs urging the anvil downward into contact with the workpiece as the hammer commences its down stroke.

* * * * *